US006086654A

United States Patent [19]

Mulvaney, III et al.

[11] Patent Number: 6,086,654

[45] Date of Patent: Jul. 11, 2000

[54] HYDRIDE REMOVAL METHOD FOR LIQUID METAL HEAT EXCHANGE FLUID IN HIGH HYDROGEN PERMEATION ENVIRONMENT

[75] Inventors: Robert C. Mulvaney, III, Arlington Heights; Steven P. Lankton, Wheeling; Stephen A. McColl, Des Plaines; Franz-Marcus Nowak, Arlington Heights, all of Ill.

[73] Assignee: UOP LLC, Des Plaines, Ill.

[21] Appl. No.: 09/222,113

[22] Filed: Dec. 29, 1998

[51] Int. Cl.[7] ..... C22B 9/00

[52] U.S. Cl. ..... 75/592; 376/312; 75/414

[58] Field of Search ..... 75/414, 592; 376/312

[56] References Cited

U.S. PATENT DOCUMENTS

| | | | |
|---|---|---|---|
| 3,941,586 | 3/1976 | McKee, Jr. | 75/66 |
| 4,290,822 | 9/1981 | Maupre et al. | 134/19 |
| 4,549,032 | 10/1985 | Moeller et al. | 585/445 |
| 4,581,200 | 4/1986 | Himeno | 376/310 |
| 4,713,214 | 12/1987 | Dumay et al. | 376/312 |
| 5,130,106 | 7/1992 | Koves et al. | 422/216 |
| 5,149,493 | 9/1992 | Latge | 376/312 |
| 5,405,586 | 4/1995 | Koves | 422/218 |
| 5,525,311 | 6/1996 | Girod et al. | 422/200 |

FOREIGN PATENT DOCUMENTS

| | | |
|---|---|---|
| 2028 297 | 6/1970 | Germany . |
| 2 170 893 | 10/1985 | United Kingdom . |

*Primary Examiner*—Melvyn Andrews
*Attorney, Agent, or Firm*—John G. Tolomei

[57] ABSTRACT

A method for purifying liquid metal heat exchange fluids uses a contacting drum in combination with purifiers to control metal hydride precipitation in a process with high hydrogen permeation. The contacting drum receives a slip stream of a circulating liquid metal stream and removes hydrogen from dissolved hydride by providing a high interfacial surface area and sufficient temperature for hydride decomposition under vacuum conditions. The liquid metal with a reduced hydride level may be returned to the circulating heat exchange stream or undergo further purification by hydride precipitation and filtration in a cold trap. The drum may be integrated with the cold traps to decompose re-dissolved hydride from a regenerant stream that dissolves precipitated hydride from the cold traps.

15 Claims, 1 Drawing Sheet

HYDRIDE REMOVAL METHOD FOR LIQUID METAL HEAT EXCHANGE FLUID IN HIGH HYDROGEN PERMEATION ENVIRONMENT

FIELD OF THE INVENTION

This invention relates to the use of liquid metals as an indirect heat exchange fluid to indirectly heat or cool fluids containing high concentrations of hydrogen.

BACKGROUND OF THE INVENTION

In many industries, like the petrochemical and chemical industries, contact of reaction fluids with a catalyst in a reactor under suitable temperature and pressure conditions effects a reaction between the components of one or more reactants in the fluids. Most of these reactions generate or absorb heat to various extents and are, therefore, exothermic or endothermic. The heating or chilling effects associated with exothermic or endothermic reactions can positively or negatively affect the operation of the reaction zone. The negative effects can include among other things: poor product production, deactivation of the catalyst, production of unwanted by-products and, in extreme cases, damage to the reaction vessel and associated piping. More typically, the undesired effects associated with temperature changes will reduce the selectivity or yield of products from the reaction zone.

Many arrangements seek to overcome the negative effects of endothermic chilling by supplying heat to the reaction or of exothermic heating by removing heat from the reaction. More traditional methods employ multiple stages of heating between adiabatic reaction stages. Other methods use in-situ heating via simultaneous reactions or indirect heat exchange to maintain an isothermal or other temperature profile within the reaction zone. U.S. Pat. No. 5,525,311 provides an example of indirect heat exchange with a heat exchange fluid to control the temperature profile within a reaction zone.

A variety of processes can employ indirect heat exchange within a reaction zone to control temperature profiles within the reaction zone. Common examples of hydrocarbon conversion reactions include: the aromatization of hydrocarbons, the reforming of hydrocarbons, the dehydrogenation of hydrocarbons, the oxidation of hydrocarbons and the alkylation of hydrocarbons. Most of these hydrocarbon conversion processes process streams having high concentrations of hydrogen.

It is known to accomplish indirect heat exchange for processes with a variety of heat exchanger configurations including shell and tube heat exchange designs or thin plates that define reaction and heat exchange channels. In such arrangements the tubes typically contain catalyst while the channels contain a heat exchange fluid or in a plate arrangement the channels alternately retain catalyst and reactants in one set of channels and a heat transfer fluid in adjacent channels. Heat exchange plates in these indirect heat exchange reactors can be flat or curved and may have surface variations such as corrugations to increase heat transfer between the heat transfer fluids and the reactants and catalysts. A specific arrangement for heat transfer and reactant channels that offers more complete temperature control can again be found in U.S. Pat. No. 5,525,311; the contents of which are hereby incorporated by reference. Other useful plate arrangements for indirect heat transfer are disclosed in U.S. Pat. No. 5,130,106 and U.S. Pat. No. 5,405,586.

High heat capacity heat transfer fluids are used in several industries to provide cooling for shell and tube heat exchanger arrangements. Various types of high heat capacity fluids include alkali liquid metals such as sodium, lithium, and potassium and include molten salts such as nitrates and carbonates. These heat transfer fluid combine high heat capacity with high thermal conductivity. British patent 2170898 generally discloses the use of sodium as a heat transfer medium in high temperature reactions including heat recovery from furnace installations, high pressure nuclear reactors, coal gasification, coal conversion, and water disassociation. U.S. Pat. No. 4,549,032 discloses the use of molten salt as an indirect heat transfer medium with a dehydration of styrene. German patent DE 2028297 discloses the use of an alkaline metal as a heat transfer medium in a process for producing alkenes and aromatics by cracking aliphatic hydrocarbons. The liquid metals are specifically used due to their high heat transfer capacity that permits utilization of small heating surfaces.

When indirectly heating or cooling hydrocarbons or other chemical feeds, the presence of hydrogen poses special problems for the use of liquid metals and other high heat capacity heat transfer fluids. Any finite hydrogen activity requires some provision for removal of metal hydride that will form from hydrogen that constantly permeates through the walls of the barrier between the fluids. Should the metal hydride concentration exceed solubility limits, the precipitation of solid hydride can interfere with the operation of the process or cause damage to equipment. Where the hydrogen permeation rate is small a chemical sorbent or getter material is used to chemically react and bind the hydrogen to prevent saturation of the metal hydride and its subsequent precipitation into the circulating system. Also the nuclear industry has used cold traps for many years to removal small quantities of sodium hydride.

Many hydrocarbon and petrochemical processes have a much higher hydrogen partial pressure on the process side of the heat exchange surfaces than the usual processes in which liquid sodium and other heat transfer fluids have been used. In many hydrocarbon conversion processes, the problem of hydrogen permeation can be severe. Many such processes work best with a relatively high hydrogen partial pressure which directly influences the problem of hydrogen permeation. Furthermore, obtaining a highly efficient heat exchange benefits from an increase in the surface area for the indirect heat exchange. As a surface area increases relative to the flowing fluid volume, the permeation of hydrogen into the liquid metal also increases. The recent trend in heat exchange arrangements for hydrocarbon conversion processes is to use a series of thin stacked plates which maximizes surface area, but at the same time, greatly increases the hydrogen permeation rate, particularly for those processes that maintain a relatively high hydrogen to hydrocarbon ratio. Therefore, it is particularly desirable to have a process that can simply and effectively control the concentration of hydrides in the liquid metal heat exchange fluid. Typical cold traps that remove hydride precipitate or getters would quickly reach their capacity limit with the high hydrogen permeation rates associated with the chemical process. Replacement of cold traps and getter material will be prohibitively costly and inconvenient.

Those skilled in the art of using liquid metals as indirect heat exchange materials have addressed the problem of eliminating impurities, in particular, hydrides from the liquid metal streams. U.S. Pat. No. 4,713,214 shows a de-gassing chamber for purifying liquid metal coolant from a fast neutron nuclear reactor using a filter element that provides the primary means of purification and a de-gassing chamber that collects bubbles of an inert gas blanket that may become entrained in the circulating liquid sodium. U.S. Pat. No. 4,581,200 uses a tank in combination with a cold trap wherein the tank deposits a sodium mist in contact with hydrogen to act as a hydrogen getter for subsequent intermediate release of hydrogen by heating of the sodium deposit. U.S. Pat. No. 4,290,822 discloses a method for cleaning a cold trap that uses sodium hydroxide to transform heated impurities into liquid phase and then draining off the liquid phase that may use vacuum conditions to remove any possible traces of water. U.S. Pat. No. 3,941,586 also teaches the purification of cold trap by heating sodium hydride to a molten state and removing or venting hydrogen gas from the cold trap. The typical apparatus associated with a cold trap comprises an economizer exchanger that transfers heat between hot, unpurified metal and the cold purified metal, a cooler for the liquid metal, and some form of retainer for a filtering element, or metallic fibers. It is known from U.S. Pat. No. 4,713,214 that cold trap devices may be integrated in a reaction vessel or may be external to the reaction vessel and involve a secondary circulation loop. U.S. Pat. No. 4,290,822 discloses the heating of cold traps with resistance heaters to maintain a temperature of about 355° C. to dissolve sodium hydride and sodium hydroxide. None of these methods are particularly suited for process fluids that have a high hydrogen concentration.

It is, therefore, an object of this invention to provide a method of removing hydride from circulating liquid metal heat exchange fluids that can accommodate a high hydrogen permeation from the process fluid.

It is a further object of this invention to provide a simplified system of removing hydrogen and the resulting metal hydride from a circulating liquid metal heat transfer fluid that facilitates the regeneration of traps for further purification of the circulating liquid metal material.

BRIEF SUMMARY OF THE INVENTION

This invention is a method of purifying liquid metal heat exchange fluids using a contacting vessel in combination with purifiers to control the metal hydride precipitation in a process that has a high hydrogen permeation. A slip stream of a circulating liquid metal enters the contacting vessel that provides a high interfacial area and sufficient temperature for hydride decomposition under vacuum conditions. The combination of vacuum conditions and temperature decompose the hydride over the extended surface area without the need for other decomposition additives. The liquid metal with a now reduced hydride level is typically circulated through a further purifier such as a cold trap that filters precipitated metal hydride to further reduce the hydride level of the circulating liquid metal.

The contacting vessel will provide sufficient surface area to reduce the metal hydride to equilibrium or near equilibrium levels for the vacuum and temperature conditions therein and will also serve to remove the hydrogen the flowing liquid metal. The contacting drum will usually be maintained at a vacuum of from 1 to 10 mm Hg and a preferred vacuum condition of from 2 to 5 mm Hg and more preferably from 2 to 3 mm Hg. The preferred temperature for the contacting vessel will be at a temperature of from 400 to 550° C. The extended surface area provided by the contacting vessel will normally have sufficient surface area to provide at least ten square meters of surface area for every cubic meter per hour and more preferably will provide at least 20 $m^2$ of surface area per $m^3$/hr of liquid passing through the contacting vessel. Trays, packing or other extended surface devices may be used within the drum to increase the surface area in the internal volume of a contacting vessel. Residence time for the liquid sodium within the contacting vessel will typically range from 2 to 5 minutes.

This invention may return a portion or all of the purified stream directly back to the circulating liquid metal stream or, preferably, will pass at least a portion of the purified stream through an additional purifier. Any type of additional purifier may be used as a zone for additional hydride removal. The preferred hydride removal zone is a cold trap that cools the liquid metal stream to precipitate the metal hydride which then filters the metal hydride from the liquid metal stream. Cold traps are preferred since they are readily regenerated by heating the liquid metal stream to dissolve the metal hydride particles that have been retained therein followed by disposal or treatment of the liquid metal stream that now contains a high concentration of dissolved metal hydride particles. The purified stream with approximate equilibrium level of hydride may pass through multiple cold traps in serial flow to reduce the final hydride concentration to desired levels. It is also possible to incorporate additional traps for the removal of other impurities. For example, the temperature of subsequent cold traps in a series may be lowered to a temperature that permits the recovery of precipitated metal oxides.

In a preferred form of the invention the contacting vessel is integrated into the regeneration of the cold traps. The contacting vessel is integrated with the regeneration by periodically passing a heated liquid metal stream through the cold trap, dissolving the metal hydride particles from the cold trap, and removing the dissolved hydride from the regeneration effluent that comprises liquid metal and dissolved metal hydride particles. The regeneration effluent is routed back to the contacting vessel to lower the hydride concentration in the regenerated stream to the equilibrium hydrogen levels of the contacting vessel. This regeneration method can advantageously be used with multiple cold traps that receive the subdivided portion of the regeneration stream at different times. In this manner, several cold traps may remain on line while one cold trap undergoes regeneration. While a cold trap undergoes regeneration, the equilibrium effluent may by-pass the cold trap and send the liquid sodium at equilibrium levels of metal hydride directly back to the circulating liquid metal material.

Accordingly in one embodiment this invention is a method for the purification of a circulating heat exchange stream in a process that uses a liquid metal for indirect heat exchange with a hydrogen containing process stream. The process circulates a liquid metal stream comprising a heat transfer fluid into contact with a heat transfer surface through which hydrogen permeates for the formation of metal hydride in the liquid metal heat transfer fluid. At least a portion of the circulating liquid metal is withdrawn as a slipstream and passed to a contacting vessel. The contacting vessel disperses the slipstream under vacuum conditions with sufficient interfacial surface area and at sufficient temperature to release hydrogen from the hydride in solution. Hydrogen is vented from the contacting vessel. The contacting vessel supplies a purified liquid metal stream containing a reduced concentration of metal hydride relative to the slipstream that may be returned to the circulating liquid metal stream.

In a more limited embodiment this invention is a method for the purification of a circulating heat exchange stream comprising a liquid metal in a process that indirectly exchanges heat with a hydrogen containing stream. The heat transfer surface for indirect heat exchange in the process permeates hydrogen into the liquid metal stream which accumulates metal hydrides in solution. The method withdraws a portion of the circulating fluid as a slipstream and passes the slipstream to a contacting drum that contacts the slipstream in the contacting drum under vacuum conditions with sufficient interfacial surface area and at sufficient temperature to release hydrogen from the hydride in solution. Decomposition moves the hydride concentration toward equilibrium hydride levels as hydrogen is vented from the contacting drum. An equilibrium stream containing a reduced concentration of metal hydride relative to the slipstream is recovered from the contacting drum. At least periodically a portion of the equilibrium stream passes to a cold trap that precipitates metal hydride particles from the equilibrium stream and collects the metal hydride particles to produce a purified stream having a reduced metal hydride concentration relative to the equilibrium stream. The purified stream returns to the circulating liquid metal stream. The method may at least periodically regenerate the cold trap by passing a heated liquid metal stream through the cold trap, dissolving metal hydride particles from the cold trap and producing a regeneration effluent stream comprising liquid metal and dissolved metal hydride particles. The regeneration effluent may be returned to the contacting drum to decompose dissolved hydride.

DETAILED DESCRIPTION OF THE INVENTION

Figure 1:
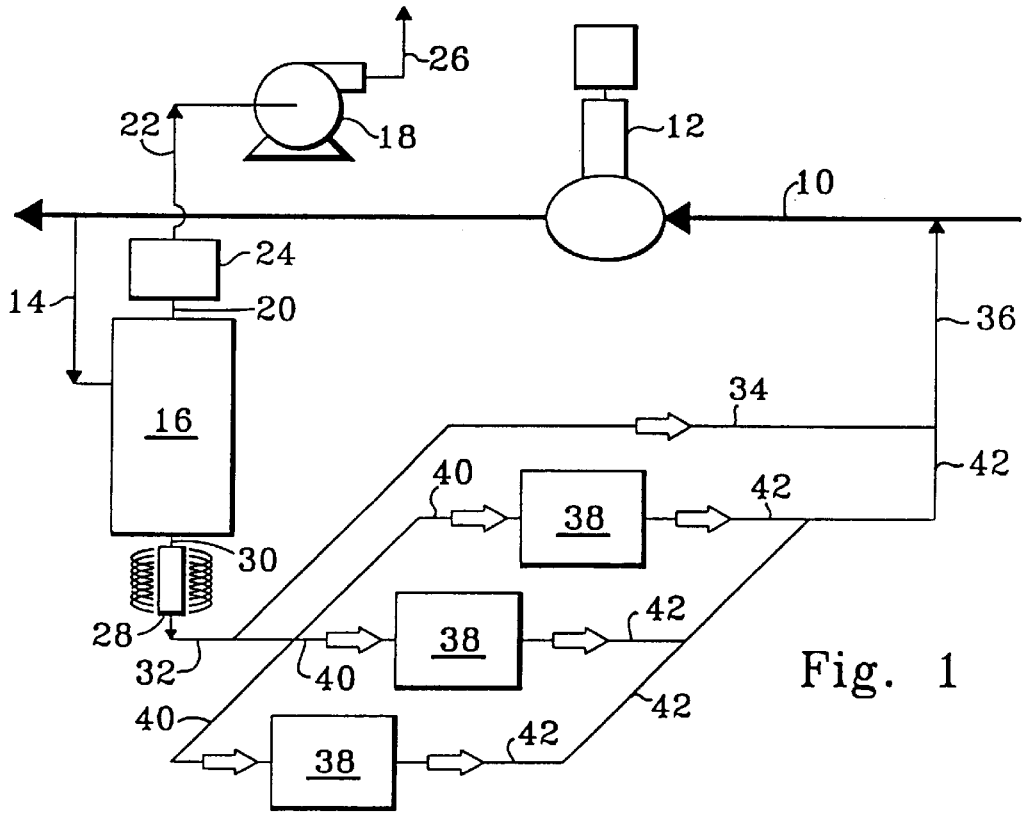
FIG. 1 is a schematic flow diagram of an arrangement of the invention.

Suitable heat exchange fluids comprise metals that maintain a liquid state at the desired heat exchange conditions of the process. Preferably, the molten metal is selected from the group consisting of sodium, potassium, lithium, lead, antimony, bismuth, and mixtures thereof. Mixtures of the above metals may form particularly useful eutectic mixtures.

The method may be useful in a wide variety of catalytic processes that use homogeneous or heterogeneous catalysts. This invention is most beneficially applied to catalytic conversion processes having high heats of reaction that process or produce streams containing molecular hydrogen. Typical reactions of this type are hydrocarbon conversion reactions that include: the aromatization of hydrocarbons, the reforming of hydrocarbons, the dehydrogenation of hydrocarbons, and the alkylation of hydrocarbons. More specific hydrocarbon conversion processes to which this invention are suited include: catalytic dehydrogenation of paraffins, reforming of naphtha feedstreams, aromatization of light hydrocarbons, and the alkylation of aromatic hydrocarbons. This method is particularly beneficial for endothermic processes such as dehydrogenation and reforming. This invention is most advantageously used in processes where the hydrogen partial pressure is at least 15 psia in the stream that is indirectly heated or cooled by the liquid metal and is more preferably used in processes where the hydrogen partial pressure of the process stream is 25 psia or greater.

Looking further at the catalytic dehydrogenation of paraffins as an example of an endothermic process, feedstocks ordinarily have from about 3 to about 18 carbon atoms. Particular feedstocks will usually contain light or heavy paraffins. The feedstock is admixed with a recycle stream comprising hydrogen and contacted with catalyst in a reaction zone. A catalytic dehydrogenation reaction is normally effected in the presence of catalyst particles comprised of one or more Group VIII noble metals (e.g., platinum, iridium, rhodium, palladium) combined with a porous carrier such as a refractory inorganic oxide. Alumina is a commonly used carrier. Dehydrogenation conditions include a temperature of from about 400° to about 900° C., a pressure of from about 0.01 to 10 atmospheres, and a liquid hourly space velocity (LHSV) of from about 0.1 to 100 $hr^{-1}$. Generally the lower the molecular weight of the feed the higher the temperature required for comparable conversions. The pressure in the dehydrogenation zone is maintained as low as practicable, consistent with equipment limitations, to maximize the chemical equilibrium advantages. The preferred dehydrogenation conditions of the process of this invention include a temperature of from about 400°–700° C. and a pressure from about 0.1 to 5 atmospheres.

The effluent stream from a dehydrogenation zone generally will contain unconverted dehydrogenatable hydrocarbons, hydrogen, and the products of dehydrogenation reactions. This effluent stream is typically cooled and passed to a hydrogen separation zone to separate a hydrogen-rich vapor phase from a hydrocarbon-rich liquid phase. Unconverted dehydrogenatable hydrocarbons are recovered and may be recycled to the dehydrogenation zone. Products of the dehydrogenation reactions are recovered as final products or as intermediate products in the preparation of other compounds. Additional information related to the operation of dehydrogenation catalysts, operating conditions, and process arrangements can be found in U.S. Pat. Nos. 4,677,237; 4,880,764 and 5,087,792; the contents of which are hereby incorporated by reference.

This invention uses a contacting vessel for the decomposition of the metal hydride from the circulating metal stream. Normally the contacting vessel will treat a smaller side stream or slipstream that equal about 1 to 5 percent of the total circulating stream and preferably equals 1 to 2% of the circulating stream. The contacting vessel will usually be maintained at a temperature of not less than about 300° C. While there is no limit on the upper temperature for the heating of the liquid metal for hydride decomposition, practical design considerations will limit the temperature to not more than about 540° C. In general, the temperature in the contacting vessel will be maintained in the temperature range of the heat transfer fluid in the process. Passage through the contacting vessel will reduce the hydrogen concentration in the liquid metal to near equilibrium levels. For the preferred vacuum conditions of the contacting vessel and the preferred liquid sodium heat transfer fluid, the effluent from the contacting vessel will have sodium hydride level of between 50 to 250 ppm and preferably a hydride level of less than 150 ppm.

To further reduce the hydride level the purified liquid metal from the contacting vessel passes through one or more cold traps. Those skilled in the art know generally how to design a variety of cold traps that can vary from complex devices to relatively simple filter elements. In typical design and operation, a cold trap passes cooled liquid metal through a filter consisting of metallic fibers which can comprise stainless steel. The hydride precipitates preferentially on the metallic fibers of such filters if the temperature of the liquid metal is sufficiently low. In this manner the devices permit cold trapping of the hydride impurity. The cold trap is typically maintained at a temperature of 250° C.

DETAILED DESCRIPTION OF THE PREFERRED EMBODIMENTS

The overall process is more fully appreciated from FIG. 1. In brief description, the drawing shows the invention applied to a circulating stream of liquid metal heat exchange fluid. FIG. 1 shows a simplified schematic. This schematic arrangement does not show valves, instrumentation, heat exchangers and other equipment that those skilled in the art will readily recognize as necessary for process control and promoting process efficiency. A portion of a circulating stream of liquid sodium is circulated through a process line 10 by a circulation pump 12. A slip stream 14 is taken downstream of pump 12 and dispersed in a contacting vessel in the form of a degassing drum 16. Drum 16 is filled with packing having appropriate size and depth to provide sufficient interfacial surface area and residence time for hydrogen disengagement. A vacuum pump 18 maintains vacuum conditions within drum 16 and withdraws a hydrogen vent stream via lines 20 and 22. The evacuated hydrogen stream passes through a condenser 24 that traps sodium vapor and knocks out any metal vapor before it enters vacuum pump 18. A line 26 delivers the recovered hydrogen to a location for safe venting, utilization as a fuel, or other recovery.

A pump 28, which may be of an electromagnetic or other type, withdraws the purified liquid metal via a line 30. A pump discharge line 32, through appropriate valving (not shown), may direct the purified liquid sodium directly back to line 10 via lines 34 and 36 or may direct all or a portion of the stream to one or more cold traps 38. In a typical arrangement 50% or more of the purified liquid sodium will return directly to the circulating stream. A network of distribution lines 40 deliver the purified liquid sodium after chilling to sufficient temperature for precipitation of the metal hydrides to the cold traps 38. A network of collection lines 42 return the further purified liquid sodium to line 10 via line 36.

Moreover, drum 16 can serve as part of an integral regeneration system for prolonging the life of cold traps indefinitely. With regeneration the life of the cold trap may be prolonged many times over its usual life expectancy.

Figure 2:
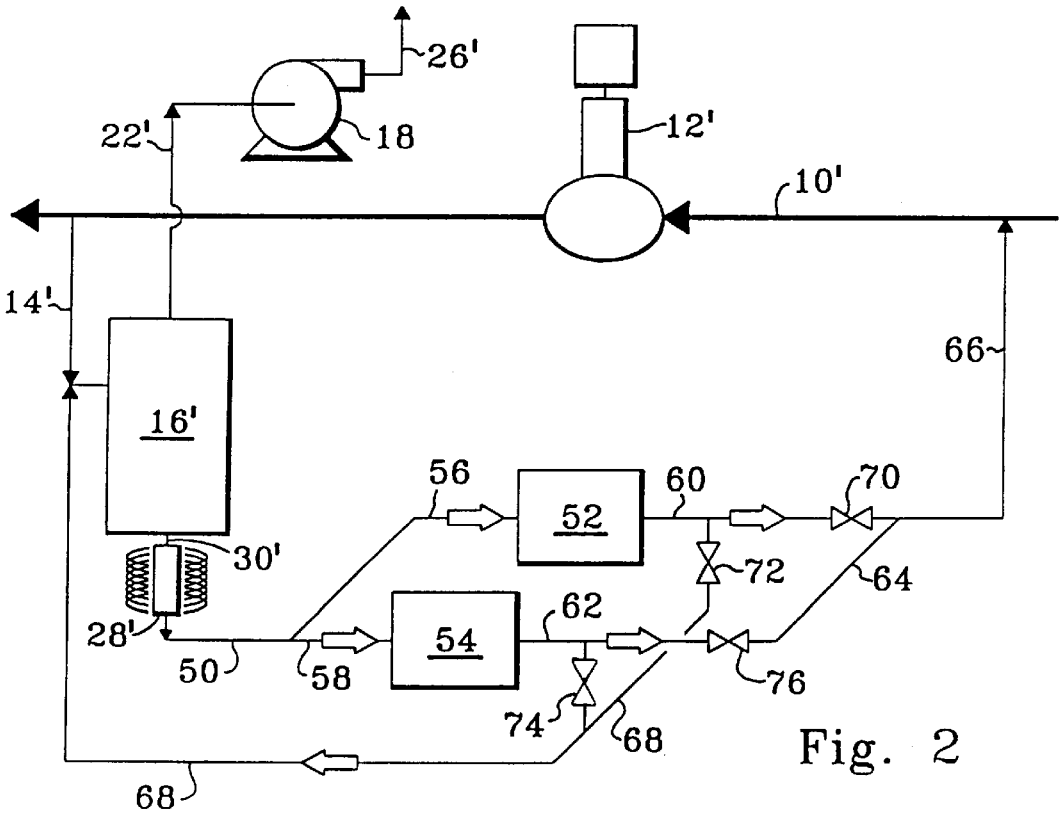
FIG. 2 is a schematic flow diagram showing a modification of the arrangement of FIG. 1.

FIG. 2 shows a schematic arrangement that modifies the flow arrangement of FIG. 1. As described in conjunction with FIG. 1, a main circulating stream of liquid sodium passes through a line 10' under forced circulation from a pump 12'. Line 14' withdraws a slip stream of the liquid metal which flows into a drum 16' for springing hydrogen gas from the liquid sodium stream to provide a purified sodium stream having a hydrogen concentration approaching equilibrium levels. A vacuum pump 18' withdraws hydrogen from drum 16' through a line 22' and discharges the hydrogen through line 26'. The liquid sodium stream, purified to near equilibrium hydride levels leaves drum 16' through a line 30'. A pump 28' drives the liquid metal into a discharge line 50. The purified stream through a cooler (not shown) to lower its temperature and precipitate solid hydride for recovery in the cold traps. The purified stream is split between a first cold trap 52 and a second cold trap 54 via delivery lines 56 and 58, respectively. During normal operations, cold traps 52 and 54 both deliver a further purified stream of liquid sodium back to line 10' lines 60, 62, 64, and 66.

The level of precipitated metal hydride in either cold traps 52 or 54 may be detected by pressure drop or other means. When sufficient precipitate has collected in either cold trap, it may be regenerated. Regeneration of cold trap 52 would begin by redirecting the outflow of cold trap 52 into a recycle line 68 by the closing of a valve 70, from its normally open position, and the opening of valve 72 from its normally closed position. Cold trap 52 then undergoes heating either by passing heated liquid sodium into the cold trap or by using in situ heating of the cold trap element by such means as electrical resistance. The cold trap is heated to a temperature that will dissolve the collected metal hydride precipitate.

The hydride laden regenerant stream passes via recycle line 68 into drum 16'. Upon entering drum 16' the liquid metal now containing a high loading of dissolved metal hydride precipitate decomposes the metal hydride and withdraws hydrogen in the manner previously described. Throughout the regeneration of cold trap 52, cold trap 54 may remain in operation as valve 74 remains closed so that all of the purified metal from cold trap 54 continues to flow through open valve 76 and back to the circulating stream in line 10' through lines 64 and 66. For simplicity the FIG. 2 shows only two cold traps however, most commercial applications will use at least three cold traps so that two may always remain on line while one undergoes regeneration.

What is claimed is:

1. A method for the purification of a circulating heat exchange stream in a process that uses a liquid metal heat exchange fluid to provides indirect heat exchange with a hydrogen containing process stream, the method comprising:

circulating a liquid metal stream comprising a heat transfer fluid into contact with a heat transfer surface that permits permeation of hydrogen into the liquid metal stream and results in the formation of metal hydride therein;

withdrawing at least a portion of the circulating fluid as a slipstream and passing the slipstream to a contacting vessel;

contacting the slipstream in the contacting vessel under vacuum conditions with sufficient interfacial surface area and at sufficient temperature to release hydrogen from the hydride in solution;

venting hydrogen from the contacting vessel;

recovering a purified liquid metal stream containing a reduced concentration of metal hydride relative to the slipstream; and, returning the purified stream to the circulating liquid metal stream.

2. The method of claim 1 wherein the purified liquid metal stream contains a near equilibrium concentration of the metal hydride.

3. The method of claim 1 wherein the contacting drum is maintained at a vacuum of from of from 1–10 mm Hg.

4. The method of claim 1 wherein the contacting vessel is maintained at a temperature of from 400 to 550° C.

5. The method of claim 1 wherein at least a portion of the purified stream is returned directly to the circulating liquid metal stream.

6. The method of claim 1 wherein at least a portion of the liquid metal stream passes through an additional hydride removal zone.

7. The method of claim 6 wherein the hydride removal zone comprises a trap that removes hydride particles from a cooled liquid metal stream.

8. The method of claim 7 wherein the trap is regenerated by passing a heated liquid metal stream into the trap to dissolve metal hydride particles and produce a regeneration effluent stream comprising liquid metal and the dissolved metal hydride particles and wherein the regeneration effluent passes into the contacting vessel.

9. The method of claim 1 wherein the contacting vessel comprises a drum containing trays for providing the interfacial surface area.

10. The method of claim 1 wherein the contacting vessel has at least 10 $m^2$ of surface area per $m^3$/hr of liquid passing through the vessel.

11. A method for the purification of a circulating heat exchange stream comprising a liquid metal in process that provides indirect heat exchange of the liquid metal with a hydrogen containing process stream, the method comprising:

circulating a liquid metal stream comprising a heat transfer fluid into contact with a heat transfer surface that permits permeation of hydrogen into the liquid metal stream and the formation of metal hydride therein;

withdrawing a portion of the circulating fluid as a slipstream and passing the slipstream to a contacting drum;

contacting the slipstream in the contacting drum under vacuum conditions with sufficient interfacial surface area and at sufficient temperature to release hydrogen from the hydride in solution and to move the hydride concentration toward equilibrium hydride levels;

venting hydrogen from the contacting drum;

recovering an equilibrium stream containing a reduced concentration of metal hydride relative to the slipstream;

at least periodically passing at least a portion of the equilibrium stream to a cold trap that precipitate metal hydride particles from the equilibrium stream and collect the metal hydride particles to produce a purified stream having a reduced metal hydride concentration relative to the equilibrium stream;

returning the purified stream to the circulating liquid metal stream;

at least periodically regenerating the cold trap by passing a heated liquid metal stream through the cold trap, dissolving metal hydride particles from the cold trap and producing a regeneration effluent stream comprising liquid metal and dissolved metal hydride particles; and, passing the regeneration effluent passes to the contacting drum.

12. The method of claim 11 wherein at least a portion of the equilibrium stream is subdivided to enter multiple cold traps in parallel flow and the multiple cold traps are regenerated at different times.

13. The method of claim 11 wherein at least a portion of the equilibrium stream passes through multiple cold traps in serial flow and the relative temperature of succeeding cold traps in the series is reduced.

14. The method of claim 13 wherein at least the last cold trap operates at a temperature low enough to recover precipitated metal oxides.

15. The method of claim 11 wherein the average residence time of the liquid metal in the contacting drum is at least 2 minutes.

* * * * *